United States Patent [19]

Morris

[11] Patent Number: 4,633,833

[45] Date of Patent: Jan. 6, 1987

[54] THROTTLES WITH HIGH VELOCITY AIRSTREAM COLLISION

[76] Inventor: George Q. Morris, 655 Paseo Esmeralda, Newbury Park, Calif. 91320

[21] Appl. No.: 687,802

[22] Filed: Dec. 31, 1984

Related U.S. Application Data

[63] Continuation of Ser. No. 617,144, Jun. 4, 1984, Pat. No. 4,491,106.

[51] Int. Cl.[4] ..... F02D 9/08

[52] U.S. Cl. ..... 123/336; 123/543; 261/65

[58] Field of Search ..... 123/336, 337, 543; 261/65

[56] References Cited

U.S. PATENT DOCUMENTS

| | | | |
|---|---|---|---|
| 3,920,778 | 11/1975 | De Rugeris | 261/65 |
| 3,943,904 | 3/1976 | Byrne | 123/336 |
| 4,066,721 | 1/1978 | Graham | 261/65 |
| 4,256,066 | 3/1981 | Serruys | 261/65 |
| 4,305,892 | 12/1981 | Hallberg | 261/65 |

*Primary Examiner*—William A. Cuchlinski, Jr.
*Attorney, Agent, or Firm*—Richard D. Slehofer

[57] ABSTRACT

A carburetion system for an internal combustion engine wherein a plurality of throttle blades cooperates with a throttle body to form channels for high speed airflow at part throttle conditions. The airflow exits the channels as coherent streams, and these streams collide downstream from the throttle to generate a region of severe velocity change which serves to finely atomize liquid fuel which has been introduced into the airflow streams.

2 Claims, 23 Drawing Figures

THROTTLES WITH HIGH VELOCITY AIRSTREAM COLLISION

This is a continuation of the U.S. application, Ser. No. 617,144, filed on June 4, 1984, now U.S. Pat. No. 4,491,106.

BACKGROUND OF THE INVENTION

This invention relates to liquid fuel supply systems in general, and more particularly pertains to fuel/air mixing and modulating systems wherein butterfly type throttle blades cooperate with a throttle body at partial throttle openings to modulate the flow of fuel and air through an air inlet passageway.

It is well known in the art of liquid fuel supply to internal combustion engines that engine efficiency improves as more of the fuel is vaporized or atomized into smaller droplets and evenly homogenized into the fuel/air mixture. The present most commonly employed system for supplying fuel to an engine is with a carburetor which uses a butterfly type valve to regulate the fuel/air supply to the engine. The blades of the valve are typically thin and flat across their entire length, and configured to cooperate with the straight walls of the air intake passageway in which the throttle valve is located. This configuration results in fuel/air mixture flow characteristics around and downstream from the throttle blade or blades which effect the fuel/air mixture adversely with respect to vaporization or atomizing fuel into small droplets and evenly mixing it with the intake air.

In the conventional carburetor using butterfly throttle blades, partial throttle intake mixture flows around both sides of the throttle blade. In this configuration, some liquid fuel tends to separate out of the mixture onto the intake passageway walls and throttle blades as the fuel/air mixture passes around the blade edges of the partially closed throttle. No provision is made for the separated fuel to re-enter the intake air for the formation of a homogenous fuel/air mixture. The separated fuel runs along the throttle blade and the walls of the engine intake passageways, and subsequently enters the cylinders in droplets that are too large for efficient combustion, resulting in reduced engine efficiency.

More recent designs have concentrated on the formation of high velocity airstreams through a convergent-divergent portion of the main intake passageway, usually constricted by a moveable conical section which functions both as a throttle and a venturi forming device. These designs, when properly engineered, have excellent fuel atomizing and mixing characteristics. However, they have notorious difficulties with proper fuel metering for all engine operating conditions. Additionally, they are difficult and expensive to construct due to the general requirement for a large number of precision machines parts which cannot be constructed using existing carburetor manufacturing tooling and techniques.

The present invention discloses a carburetor throttle and throttle body assembly which avoids the unfavorable fuel separation problems of more conventional designs, yet achieves the partial throttle efficiency of the conical venturi designs without the adverse effects on fuel metering and without the extraordinary and expensive construction requirements.

According to the present invention there is provided a novel carburetor throttle assembly wherein butterfly type throttle blades have regions of cooperation with the throttle body such that channels are formed at partial throttle openings. As the throttle blades rotate open at partial throttle settings, the channels open much more quickly than other seal areas, so substantially all of the part throttle intake mixture flows through the channels. Separation of liquid fuel onto the throttle body can be controlled or prevented. The walls of the throttle body can be heated to enhance vaporization of any separated fuel. As convergent high speed fuel/air streams exiting the channels collide downstream from the throttles, liquid fuel is finely atomized and thoroughly mixed with the intake air.

The resulting improvement of fuel atomization and vaporization at partial throttle openings results in a corresponding improvement in engine efficiency at partial load conditions.

SUMMARY OF THE INVENTION

This invention relates in general to carburetors having butterfly type throttle valves, and more particularly pertains to a novel carburetor mixing and modulating throttle design wherein channels are formed at partial throttle openings at a region of cooperation between butterfly type throttle blades and surfaces of the throttle body. In passing through these channels, the inlet mixture undergoes a severe change in velocity. Mixture flows through these channels at very high speeds, due to the large pressure difference that normally exits across the throttle at partial throttle openings.

The channels are configured such that the high speed fuel/air mixture streams exiting the channels collide in the intake downstream from the throttles to form regions of severe turbulence which thoroughly atomize liquid fuel and evenly mix it into the intake air.

The walls of the throttle body can be heated to enhance vaporization of liquid fuel which separates out of the mixture onto those walls.

At larger throttle openings, the channels become essentially indistinct from the main mixture passageway. Thus, the fuel/air mixture at large engine loads can flow through a larger area with less restriction, resulting in greater engine power.

The cooperating surfaces of the throttle blades with the walls of the throttle body can be shaped to give many desirable cross sectional configurations to the novel channels. The channels may be straight-walled for manufacturing simplicity, may have a venturi shape for enhanced velocity characteristics, may be curved, or may be convergent or divergent for special flow effects.

Since the present invention concerns a throttle design utilizing butterfly type throttle valves, it is reasonably easy to construct with present techniques for manufacturing such equipment.

Accordingly, one object of the present invention is to provide a fuel/air mixing and modulating throttle design that is simple and lends itself well to conventional manufacturing techniques.

Another object is to provide a throttle design for a carburetor which forms channels between the throttle blades and cooperating walls of the throttle body in the intake passageway at partial throttle openings.

Another object is to provide a throttle design forming channels between the throttle blades and cooperating walls of the throttle body in the intake passageway wherein the fuel/air mixture flows at high speed at partial throttle openings.

Another object is to provide a throttle design wherein cooperation between the throttle blades and the throttle body forms flow channels which can direct the fuel/air mixture flow in such a manner to control liquid fuel separation from the fuel/air mixture.

Yet another object is to provide a carburetor throttle design wherein a plurality of throttle blades can form multiple channels at regions of cooperation with the walls of an extension of the throttle body located in the air intake passageway.

A still further object is to provide a throttle design for a carburetor body containing an air intake passageway, where a plurality of throttle blades forms multiple channels at regions of cooperation with walls of the air intake passageway, and where high speed fuel/air mixture streams exiting the channels at partial throttle openings collide in a region of the intake passageway downstream from the throttle blades to form a region of severe turbulence for finely atomizing liquid fuel in the fuel/air mixture.

These and other objects will become more clear from the following description when considered in conjunction with the several Figures, wherein like reference numerals refer to like parts throughout.

DETAILED DESCRIPTION OF THE PREFERED EMBODIMENTS

Figure 1:
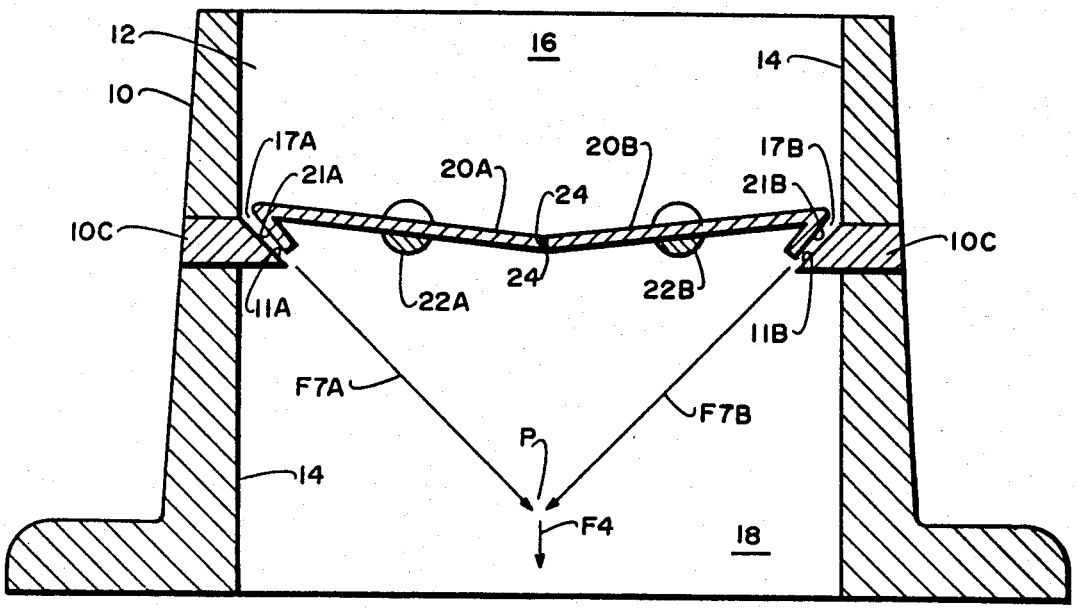
FIG. 1 is a cross sectional view of an embodiment of the present invention wherein two throttle blades are disposed in a common intake passageway.
Figure 13:
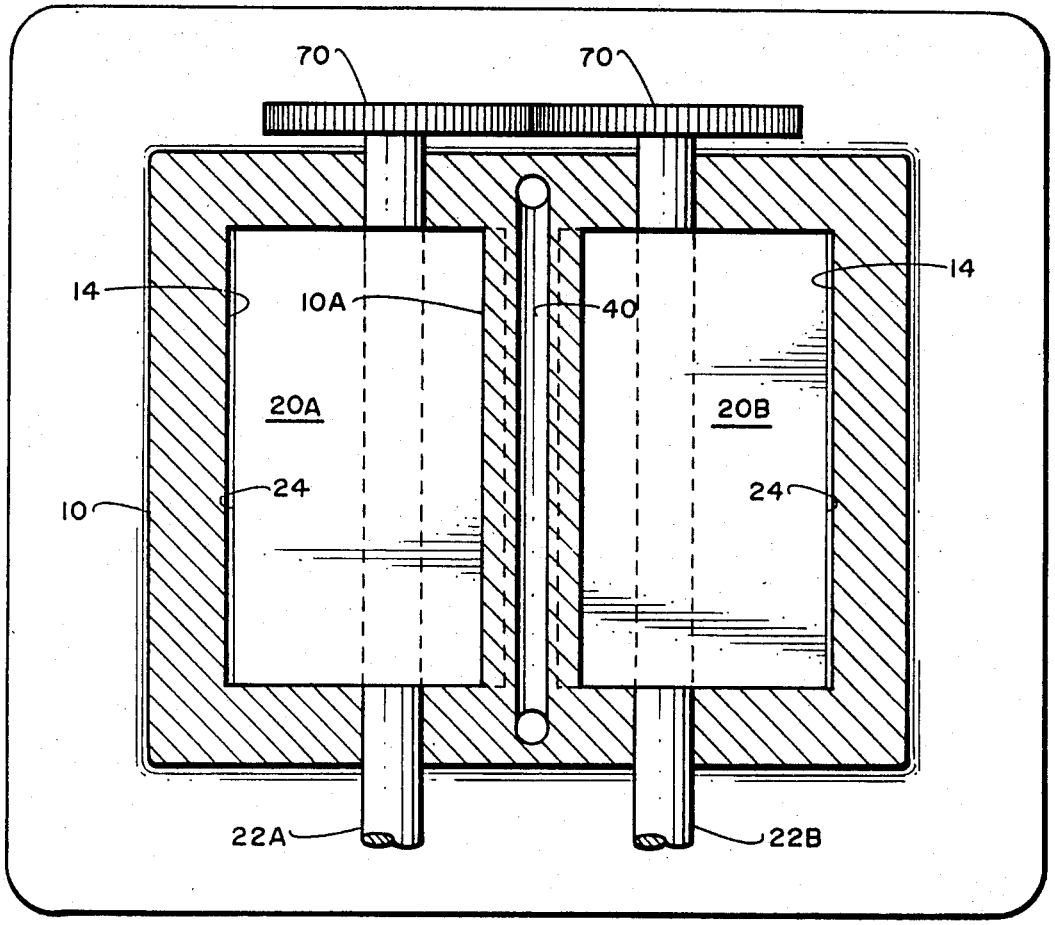
FIG. 13 is a top view of the embodiment of FIG. 12, taken along the line 26—26.

Referring to FIG. 1, there is provided an embodiment of the present invention having a throttle body indicated generally at 10. The throttle body is adapted to be connected to the intake passageway or manifold of an internal combustion engine (not shown) for supplying a fuel and air charge thereto. Throttle body 10 has interior walls 14 which define an air inlet passageway, generally indicated at 12, which is preferably of rectilinear cross section. Inlet air for supplying the engine flows through the air inlet passageway 12 of the carburetor from the upstream end, generally indicated at 16, to the downstream end, generally indicated at 18. The upstream end 16 of passageway 12 is adapted to communicate with atmospheric air, preferably through a conventional air filter (not shown). Disposed in the inlet 12 are two butterfly type throttle blades 20A and 20B. Rotatable throttle shafts 22A and 22B are journaled in throttle body 10. Throttle blade 20A is affixed to shaft 22B so that the throttle blades can be rotated in the air inlet in the conventional manner so as to regulate the air flowing through the air inlet. The shafts 22A and 22B are rotatably connected for coordinated or synchronized rotation by gear means (as best illustrated in FIG. 13) or by other suitable means. FIG. 1 illustrates the throttles in the substantially closed position; for opening motion of the throttles the shaft 22A rotates in a clockwise direction in coordination with the shaft 22B, which rotates an equal amount in the counterclockwise direction. The throttle shafts 22A and 22B are positioned in the inlet 12 such that their axis of rotation are essentially parallel. The throttle blades 20A and 20B are preferably essentially rectangular for close cooperation in the essentially rectilinear air inlet 12. The throttle blades 22A and 22B are situated in the air inlet 12 such that when the throttles are in the fully closed position, the edges 24 of the throttle blades cooperate closely to preclude substantial flow of air between them. The throttle blade surfaces 21A and 21B cooperate with throttle body air inlet surfaces 11A and 11B respectively to form throttle channels 17A and 17B respectively. The surfaces 11A and 11B may be formed as part of section 10C of the throttle body 10. Section 10C can be made adjustably moveable with respect to the throttle body and throttle blades, and hence can be positioned to determine the exact amount of clearance between the throttle blades and the throttle body after the system is assembled.

The throttle blades have seal regions at the edges (not shown in FIG. 1 but clearly illustrated as 28 in FIG. 4) which maintain a seal throughout substantially the entire range of throttle positions.

For a detailed description of the operation of the invention, it will be assumed that the engine associated with the carburetor of FIG. 1 has been started and is operating at idle load conditions. The fully closed throttle blades would preclude substantial flow of inlet air, since the cooperation of blade edges 24 form a seal, the cooperation of surfaces 21A and 11A form a seal, and the cooperation of surfaces 21B and 11B form a seal. Hence, idle air would have to be supplied from an alternate source (not shown), or the throttles would have to be adjusted to a position that is more open than the fully closed position as shown.

With the throttles more open than the fully closed position, the surfaces 21 and 11 are sufficiently separated so that the channels 17 have significant cross sectional opening. Air in inlet 12 upstream from the throttles 20 is at essentially atmospheric pressure, while the inlet at 18 downstream from throttles 20 is at a considerable vacuum. In response to this strong pressure difference, inlet air flows at high speeds through the channels 17.

Air exits the channels 17A and 17B as coherent high speed streams of inlet air. The exit stream from channel 17A has a path as shown by the arrow F7A, while the exit stream from channel 17B has a path as shown by the arrow F7B. As clearly seen in FIG. 1, the channels 17 are situated such that the the exit stream F7A from channel 17A converges with the exit stream F7B from channel 17B. The two converging exit streams collide at the point shown as P. After the collision, the inlet air flows more directly down the inlet with a path shown at F4. The path of the airstream at F4 is determined by the relative angles and flow mass of the exit airstreams according to the law of conservation of momentum. The inlet flow at F4 is very turbulent, and is a much less coherent and lower speed airstream than the exit streams from the channels.

FIG. 1 illustrates the invention as it acts to control the inlet flow, without indicating a specific requirement for the location of where the fuel enters into the inlet airstream. It is to be understood that fuel could be introduced into the inlet airstream of the invention of FIG. 1 anyhwere upstream from the throttles, in the channels, or anywhere downstream from the throttles as long as the fuel is mixed into the inlet air upstream from the point of collision P. Thus, the colliding streams at P would contain both fuel and air.

The severe velocity change at point P serves to very finely atomize fuel entrained in the channel exit streams. Also, the resulting inlet flow after the collision, as indicated at F4, flows relatively straight down the passageway 12 and thus the entrained fuel has a greatly reduced tendency to separate onto the walls 14. As a result, the finely atomized fuel remains suspended in the inlet air for improved engine efficiency.

As more intake air is required by the engine, the throttle blade is rotated to a more open position. As the throttle rotates open, surfaces 21 move away from cooperating surface 11. It should be appreciated at this point that there are two potential flow paths for intake air past the partially open throttle blades. One path is between blade edges 24; the other path through the channels 17. The sides of the throttle blades, not visible in this Figure but shown as 28 in a subsequent Figure, remain in close cooperation with the walls 14 throughout the entire range of partially open throttle positions so as to effectively provide a seal against flow of mixture. For the initial few degrees of opening throttle movement from the fully closed position, the edges 24 move in close coooperation; therefore there is no appreciable air flow between surfaces 24. However, for the same few degrees of initial throttle movement, the surfaces 21 are moving more perpendicular to surfaces 11; thus the channels 17 open relatively rapidly. Therefore, the increase in air flow here is rapid. The result is that, for the initial part of opening the throttle blade from the closed position, essentially all the inlet flow is through the channels 17.

When an even greater flow of fuel/air mixture is required for higher engine power output, the throttle blades are rotated open still further. As the throttles are rotated to a more open position, surfaces 21 become quite distant from cooperating surfaces 11. The tendency is now for the channels 17 to become indistinct from the overall passageway 12, as a whole. Also, at larger throttle openings, the separation between throttle edges 24 becomes significant, and thus a major contribution to the overall flow through passageway 12 passes through this increased separation.

The foregoing embodiment of the invention is capable of efficient mixing and modulating of the fuel/air mixture, especially at partial throttle openings. It is very common for the pressure difference across the throttle blades to be great enough to cause the mixture speed through the channels to flow at sonic velocities for most of the operating conditions common to present day engines in automotive use. Thus, fuel droplets passing through the channel will be subjected to severe levels of turbulence in, and upon exiting the channel. This condition results in very efficient atomization of the liquid fuel, where the term atomization refers to breaking liquid fuel droplets down into smaller droplets.

It is not important what type of device is employed for providing fuel. For purposes of simplicity, the fuel outlet may be one of the many designs which use a venturi signal to meter the proper quantity of fuel into the passageway 12. However, any injection method would work equally well. A plurality of fuel outlets might even prove advantageous for evenly distributing the fuel into the mixture at large throttle openings.

It was previously mentioned that the channel opens quickly as the throttle blade is rotated from the closed position. Thus, the mixture supply to the engine increases quickly for very small increases in throttle opening. In the conventional configurations for butterfly type throttle valves as used in automotive carburetors, all edges of the blade which cooperate with the throttle body for seal formation move initially from idle in a direction that is essentially parallel to the intake walls. Thus, initial mixture flow increase is gradual, and the throttle pivot shaft can be advantageously operated directly from the foot-controlled linkage. In the embodiment of the present invention just described, initial flow increase from idle is extremely rapid, and the path of flow increase may need to be controlled by rotating the throttle indirectly. This might be accomplished by a method such as using a specially profiled cam to open the throttle, where the vehicle operator foot-controlled linkage operates the cam.

Also, since the channel opens rapidly from the closed throttle position, the channel attains a substantial cross section before significant flow occurs between the blade edges 24. In may embodiments of the present invention for automotive application, the intake mixture flow is substantially only through the channel even at maximum cruising speed of the vehicle. Thus, the enhanced atomization characteristics provided by the flow through the channel are realized for most vehicle operating conditions, the exception being rapid acceleration.

Figure 2:
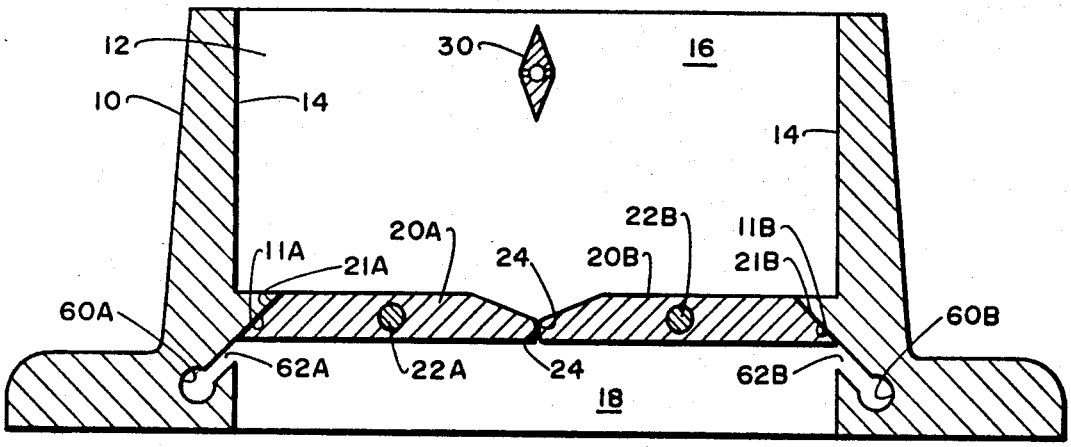
FIG. 2 is a cross sectional view of an embodiment of the present invention having two throttle blades and wherein the mixture streams are directed into passageways.

FIG. 2 illustrates an embodiment of the invention wherein two throttle blades, operating in a similar manner to the configuration of FIG. 1, are located in the air intake passageway. In FIG. 2, throttle surfaces 21A and 21B cooperate with surfaces 11A and 11B respectively to form channels 17A and 17B. The channels function as described for the channel of FIG. 1. In this embodiment, the exit streams from the channels at part throttle operation can be directed at the passageways 60A and 60B which transport the fuel to a heater (not shown) where heat is imparted to the liquid fuel to vaporize it. The resultant vaporized fuel mixture is then returned to the passageway 12 downstream from the throttles (not shown).

Figure 3:
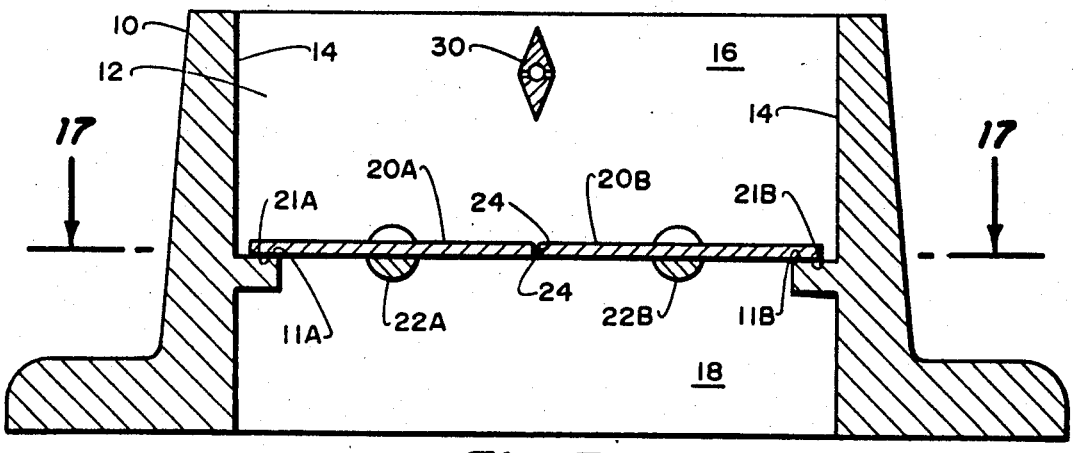
FIG. 3 is a cross sectional view of an embodiment of the present invention wherein the throttle blades are formed inexpensively from sheet or strip stock.

FIG. 3 illustrates an embodiment of the invention wherein the throttle blades are easily and inexpensively formed by being stamped from sheet or strip stock. The surfaces 11A and 11B are also formed as a more simple shape on the throttle body. In FIG. 3, the channel exit streams flow along the downstream surfaces of the throttle blades, and may impinge on the throttle shafts 22 before colliding.

Figure 4:
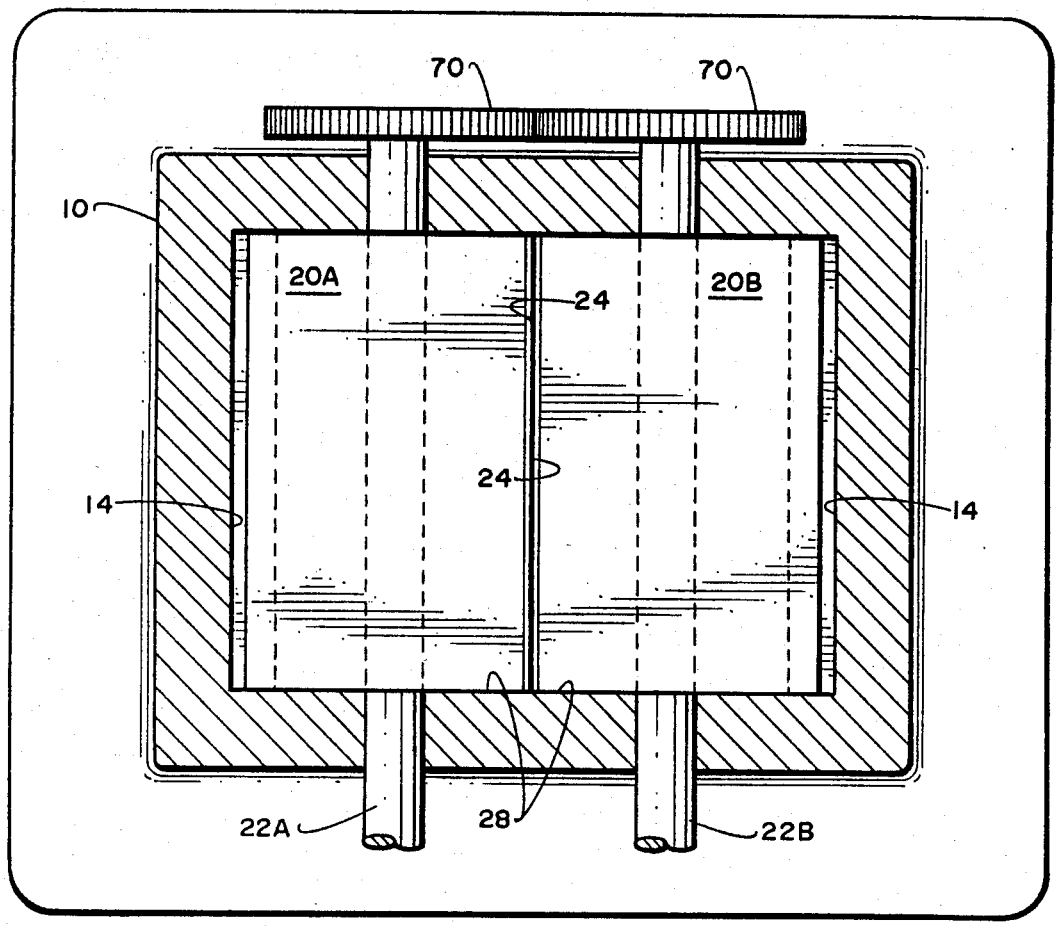
FIG. 4 is a top view of the embodiment of FIG. 3, taken along the line 17—17.

FIG. 4 illustrates a top view of a section of the embodiment of FIG. 3, taken along the line 17—17. Illustrated more clearly in FIG. 4 are the synchronous gears 70 which drive the shafts 22A and 22B. Also shown are the sides 28 of the throttle blades, which maintain close cooperation with the walls 14 of the air intake to effect a seal.

Figure 5:
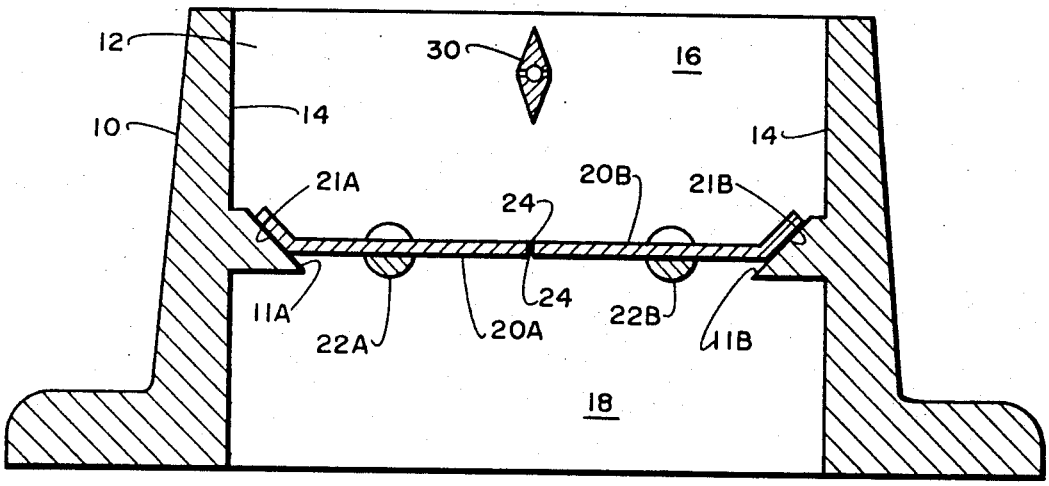
FIG. 5 is a cross sectional view of an embodiment of the present invention wherein the throttle blades are formed inexpensively from sheet or strip stock.

FIG. 5 is an improvement on the invention of FIG. 3, wherein the throttle blades are stamped from sheet or strip metal stock, but formed with an easily created angle so that the channel exit streams flow away from the throttle surfaces and collide further downstream from the throttle blades.

Figure 6:
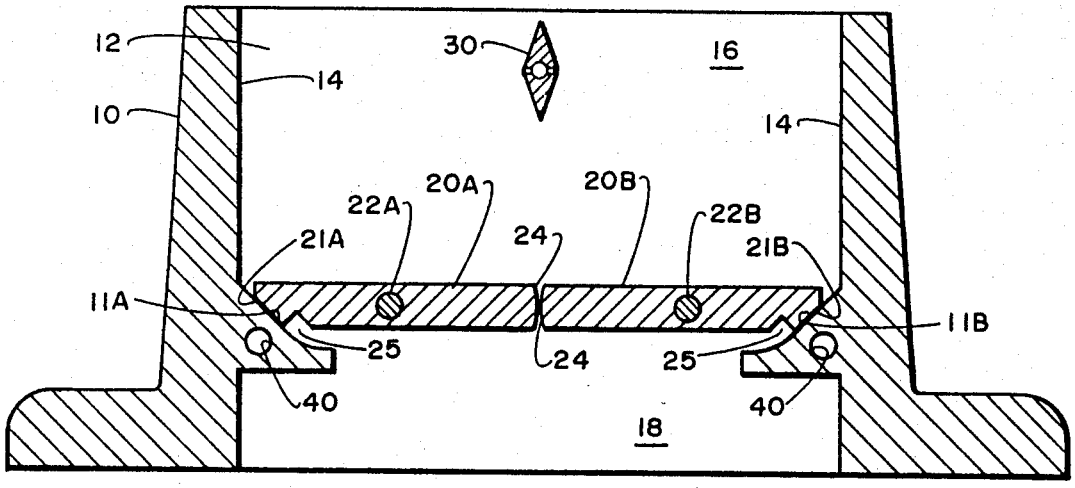
FIG. 6 is a cross sectional view of an embodiment of the present invention wherein a portion of the throttle blade is shaped.

FIG. 6 illustrates an embodiment of the invention employing two throttle blades and having curved channels. In the embodiment of FIG. 6, the surfaces 11A and 11B are extended, and the extended part curved to direct the channel exit mixture streams to converge at a point closer to the downstream surfaces of the throttle blades 20A and 20B. Additionally, the curve of the extended part of 11A and 11B enhances centrifugal separation of liquid fuel from the channel exit streams.

Figure 7:
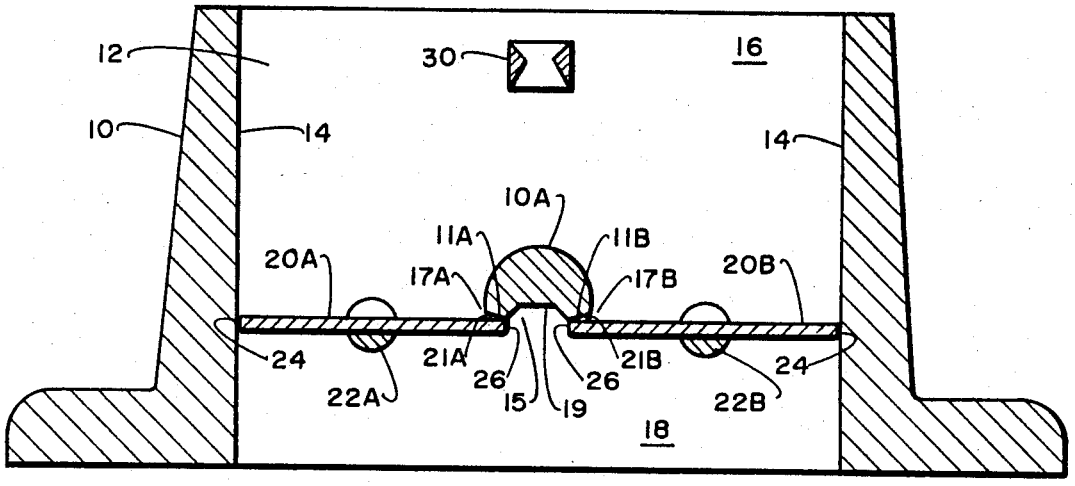
FIG. 7 is a cross sectional view of one embodiment of the present invention wherein the channels are formed at a location of cooperation with a transverse extension of the throttle body.

Referring now to FIG. 7, there is illustrated a further embodiment of the present novel fuel/air mixing and modulation device having the channels formed by the cooperation of the throttle blades with an extension of the throttle body extending transversely across the central portion of the air intake passageway.

In the configuration of FIG. 7, there is a throttle body generally indicated at 10. The throttle body is adapted to be connected to the induction intake passageway of an internal combustion engine (not shown) for supplying a fuel/air charge thereto. Throttle body 10 defines an internal air intake passageway, of rectilinear cross section, generally indicated at 12. The walls 14 of throttle body 10 bound the air intake 12. Air intake 12 has an upstream end, generally indicated at 16, and a downstream end, generally indicated at 18. Induction air for supply to the engine flows through the intake passageway 12 in the direction of upstream to downstream. The upstream end of the passageway is adapted to communicate with the atmosphere, preferably through a conventional air fliter (not shown). Extending transversely across the central part of intake passageway 12 is an extension 10A of the throttle body 10. A recessed region 19 is formed in the transverse extension 10A. Disposed in intake passageway 12 are butterfly type throttle blades 20A and 20B. Throttle blade 20A is affixed to rotatable shaft 22A, and throttle blade 20B is affixed to rotatable shaft 22B. The shafts 22A and 22B are formed with a flat surface suitable for accommodating the flat throttle blades 20A and 20B for mounting. Shafts 22A and 22B are rotatably interconnected for coordinated rotation in opposite directions by gear means (not shown). For opening motion of the throttles shown in FIG. 7, shaft 22A rotates in a clockwise direction, while shaft 22B rotates an equal number of degrees in a counterclockwise direction. In the case of application for providing fuel to an automotive engine, the rotatably interconnected shafts are adapted with suitable linkage (not shown) to be rotated by the vehicle operator. The throttle shafts 22A and 22B are positioned in the intake 12 such that their axis of rotation are essentially parallel to one another. The throttle blades 20A and 20B are rectangular, and preferably formed by being stamped from sheet or strip metal stock and precision machines to final shape tolerance. The throttle blade/shaft assemblies are located in the intake passageway 12 such that when the throttles are in the fully closed position the edges 24 of the throttle blades cooperate closely with the walls 14 to preclude substantial flow of intake air through the passageway 12. The transverse extension 10A of the throttle body has surfaces 11A and 11B. Throttle blades 20A and 20B have surfaces 21A and 21B respectively, such that surface 11A cooperates with surface 21A, and surface 11B cooperates with surface 21B. The lines of cooperation of surfaces 11A, 11B, 21A, and 21B are essentially parallel to the axis of rotation of the throttle blades such that at fully closed throttle positions surface 11A touches along surface 21A, and surface 11B touches along surface 21B to form a seal to preclude substantial flow of air past these cooperating surfaces. At closed throttle blade positions, a substantial amount of clearance is provided between the edges 26 of blades 20A and 20B which are nearest one another centrally in passageway 12. This clearance forms a flow region which is indicated generally at 15. The cooperation between surfaces 11A and 21A forms a channel 17A; the cooperation between surfaces 11B and 21B forms a channel 17B. Channels 17A and 17B are effectively closed at closed throttle positions. A fuel outlet 30 is positioned in intake passageway 12 upstream of the throttle blades 20A and 20B. Fuel is delivered from outlet 30 to the intake air flowing through passageway 12, in proportion to the quantity of air flowing through intake 12, controlled by means (not shown), which may be any conventional means.

In the embodiment illustrated in FIG. 7, the throttle blades are shown in the fully closed position. The close cooperation of the throttle blade edges 24 with walls 14, in addition to the closure formed by the cooperation of surface 11A with 21A and surface 11B with 21B, forms a seal which precludes substantial flow of air through passageway 12 at closed throttle conditions.

For a detailed description of the operation of this embodiment of the invention, it will be assumed that the engine fueled through the present invention has been started and is operating at idle load conditions. Referring to FIG. 7, the fully closed throttle blades preclude substantial flow through passageway 12, and the majority of engine idle fuel/air mixture would have to be supplied by an auxiliary means (not shown). Otherwise, the throttle blades 20A and 20B would have to be rotated to a more open position to supply the required engine idle air.

Figure 8:
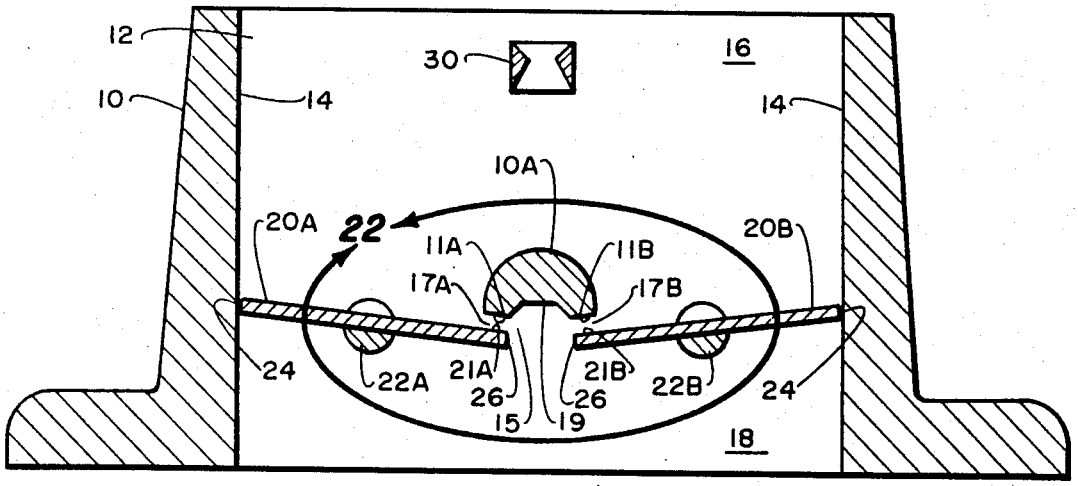
FIG. 8 is a cross sectional view showing the embodiment as in FIG. 7, with the throttles in a partially open position.

As more intake air is required by the engine, the throttle blades are rotated to a more open position, as shown in FIG. 8. Since the throttle shafts are adapted for coordinated rotation in opposite directions, they rotate open as shown in FIG. 8 where surfaces 21A and 21B move away from their respective cooperating surfaces 11A and 11B. Thus, throttle 22A rotates open in a clockwise direction, while throttle 22B rotates open in a counterclockwise direction. Arrow 22 indicates the opening rotation of the throttles. It should be appreciated at this point that there are two potential flow paths for intake air past the partially open throttle blades: one path is between blade edges 24 and walls 14; the other path through the channels 17A and 17B. For the initial few degrees of opening throttle movement from the fully closed position, the edges 24 are moving essentially parallel to walls 14; therefore the rate of increase of the opening between these cooperating surfaces is at its minimum. Thus, there is little appreciable increase of air flow between surfaces 24 and 14. However, for the same few degrees of initial throttle movement, the surfaces 21A and 21B are moving perpendicular to surfaces 11A and 11B respectively; thus the channels 17A and 17B open relatively rapidly. Here, the increase in air flow is rapid. The result is that, for the initial part of opening the throttle blades from the closed position, essentially all the fuel/air mixture flow is through the channels 17A and 17B.

At partial throttle openings as shown in FIG. 8, fuel is delivered from outlet 30 to the intake air as liquid droplets. The resultant fuel/air mixture flows in a downstream direction toward the throttle blades. At small throttle openings, substantially all the fuel/air mixture flows through the channels 17A and 17B, so the fuel/air mixure downstream of outlet 30 begins to move laterally toward the center of the passageway 12 preparatory to entering the channels 17A and 17B. The fuel/air mixture then enters the channels. Since the channels have essentially equal flow areas, the total flow through the passageway 12 will divide itself equally to flow through the channels. To more closely examine the flow through the channels, reference is had to FIG. 9.

Figure 9:
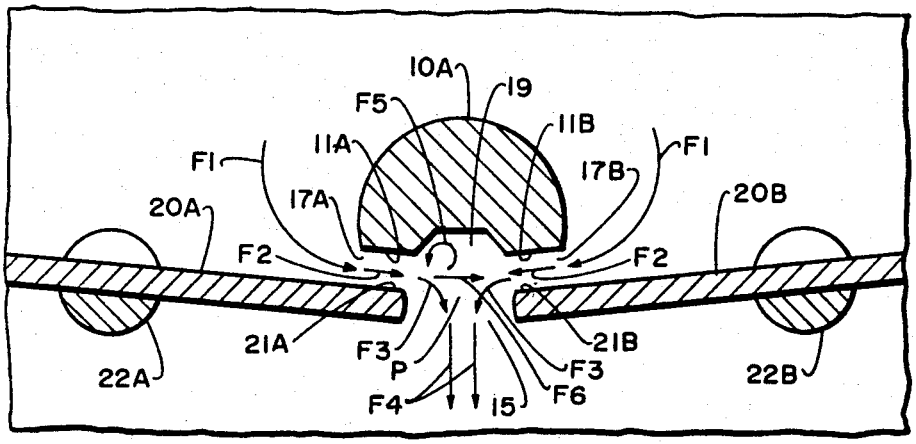
FIG. 9 is an enlarged cross sectional view of the throttle blade cooperation region of the embodiment illustrated in FIG. 8, showing mixture flow paths.

FIG. 9 is an enlargement of the channel area of FIG. 8, with arrows to indicate fuel/air mixture flow. Initially, the fuel/air mixture upstream of the throttles, before entering the channels, has divided itself into equal flows, shown by arrows labelled F1. As the fuel/air mixture enters the restriction formed by the channels 17A and 17B, the flow is accelerated to high speed streams, due to the large pressure difference that exists across the throttles, and therefore across the channels, when the engine is operating under partial throttle conditions. This high speed flow is indicated by arrows labelled F2. Note that the streams from the channels 17A and 17B are now flowing towards one another. As the high speed streams exit the channels into region 15, they collide in region 15 as indicated at P. This collision causes the streams to undergo a severe change in velocity, which results in an overall change in the flow direction of fuel/air mixture as indicated by the arrows F3, and resultant movement in a direction parallel to the axis of passageway 12, as indicated by the arrows F4. The presence of recess 19 in extension 10A results in the formation of counterflow eddies indicated at F5. These counterflow eddies tend to carry any liquid fuel which separates onto the surface of extension 10A back into the high speed channel flow, where thorough atomization can occur.

A very advantageous effect of the flow through the channels 17A and 17B can now be seen, with reference to FIG. 9. Larger liquid fuel droplets, delivered by outlet 30, may be present in the intake ar upstream of the throttles. These droplets would participate poorly in the combustion process, and result in engine inefficiency. As the large droplets are carried into the channels with the flow indicated by arrows F2, they are accelerated to the approximate velocity of the rest of the fuel/air mixture stream. This acceleration causes fuel droplets to be broken down into smaller droplets. Then, when the droplets in the channel exit streams reach the region P of stream collision, the inertia of the larger droplets causes them to traverse the region P and enter the flow of the opposing stream from the opposite channel, they experience an extreme and rapid change in the relative flow of the surrounding fluids. The resultant shear effects reduce a large fuel droplet to many very small droplets. The result is very fine atomization of the liquid fuel passing through the channels, particularly at smaller throttle openings.

When an even greater flow of fuel/air mixture is required for higher engine power output, the throttle blades are rotated open still further. As the throttle blades are rotated to a more open position, surfaces 21A and 21B become quite distant from their cooperating surfaces 11A and 11B respectively. The tendency is now for the channels 17A and 17B to become indistinct from the overall passageway 12 as a whole. Also, at larger throttle openings, the separation between walls 14 and throttle edges 24 becomes significant, and thus a major contribution to the overall flow through passageway 12 passes through this increased separation.

Figure 10:
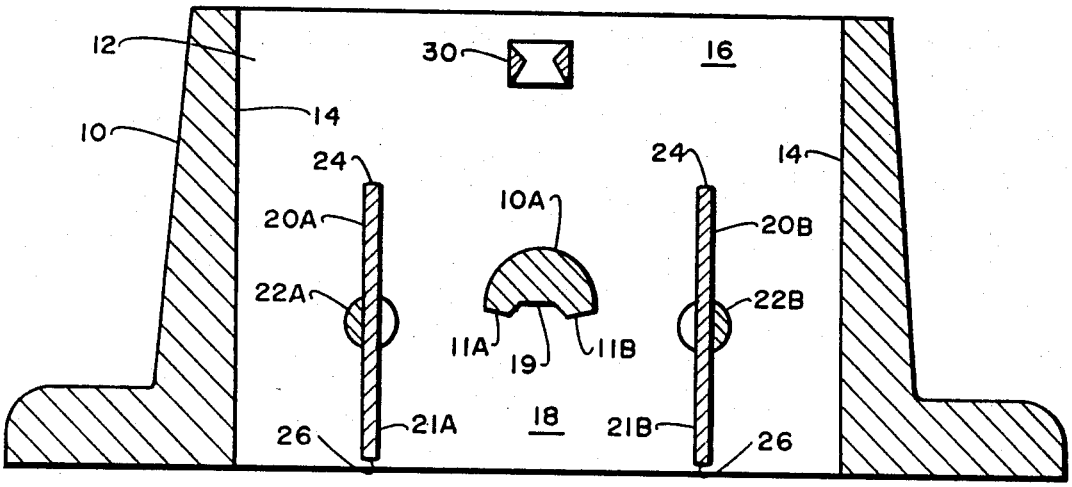
FIG. 10 is a cross sectional view showing an embodiment as in FIG. 7, with the throttles in a fully open position.

FIG. 10 illustrates the embodiment of FIG. 7 and FIG. 8, with the throttle blades rotated open to the maximum extent. It is very evident from FIG. 10 that channels have deformed to the extent that they are not recognizable entities at maximum throttle openings. Thus, the fuel/air mixture flows freely to the engine for maximum power.

The foregoing embodiment of the invention is capable of very efficient mixing and modulating of the fuel/air mixture, especially at partial throttle openings. It is very common for the pressure difference across the throttle blades to be great enough to cause the mixture speed through the channels to flow at sonic velocities for most of the operating conditions common to present day engines in automotive use. Thus, any fuel droplet large enough to traverse the region of collision of the two channel exit streams into the stream of the opposite channel will quickly be in a situation where the relative mixture flow will approach twice sonic velocity in the opposite direction. This condition results in very efficient atomization of the liquid fuel, where the term atomization refers to breaking liquid fuel droplets down into smaller droplets.

It is not important what type of device is employed for the fuel outlet 30. Four purposes of simplicity, the fuel outlet may be one of the many designs which use a venturi signal to meter the proper quantity of fuel into the passageway 12. However, any injection method would work equally well. A plurality of fuel outlets might even prove advantageous for evenly distributing the fuel into the mixture at large throttle openings.

It will be noted that from FIGS. 7–10 that the surfaces 11A and 11B are angled slightly with respect to their respective cooperating surfaces 21A and 21B at closed throttle positions. The purpose of the angle is to provide channels that are of convergent cross section at very small throttle openings, and essentially even cross section at moderate throttle openings. These angular relationships have been shown to be advantageous for maximizing flow conditions through the channels and out from the channels, at intake flows representing most automotive operation situations, in a device that is economical to construct.

With reference particularly to FIG. 9, it will be noted that the fuel/air mixture changes velocity rapidly at the entrances to the channels. This rapid change in velocity tends to cause liquid fuel to separate out of the mixture onto the surfaces 21A and 12B of the throttles. At the exit ends of the channels, where the ends 26 of the throttle blades are located, this separated fuel tends to re-enter the exit streams from the channels and be finely atomized by the turbulence that exists in the region 15, and particularly where the re-entrant fuel crosses the region at P into the flow from the opposing channel, as previously described.

Figure 11:
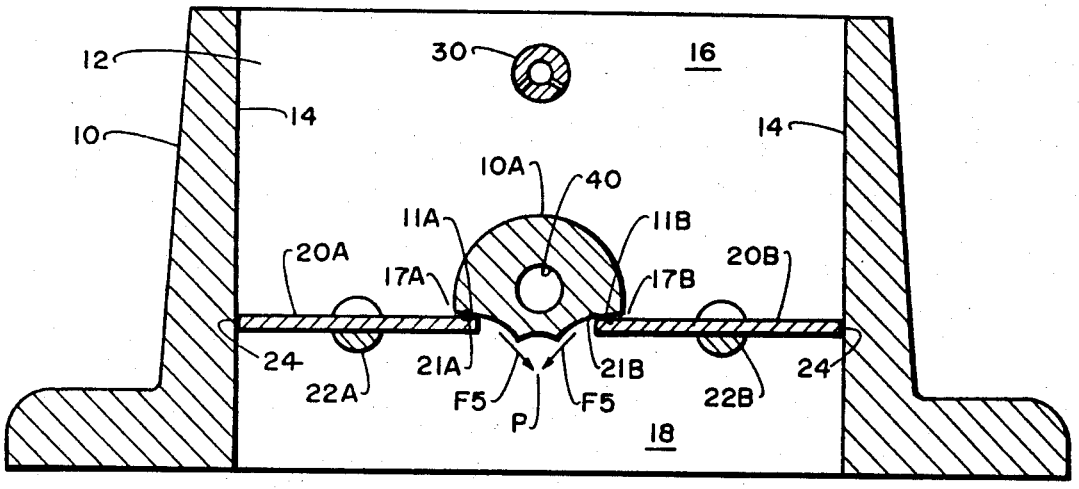
FIG. 11 is a cross sectional view of one embodiment of the present invention wherein the channel flow surfaces are curved.

FIG. 11 illustrates an embodiment of the present invention wherein separation of liquid fuel is encouraged at partial throttle openings. The surfaces 11A and 11B of the transverse extension 10A are curved, as illustrated, in a direction which guides the channel exit streams back toward the axis of the passageway 12. FIG. 11 shows the throttle blades in a closed position. When the blades are opened for increased mixture flow, the high speed mixture streams exiting the channels flow along the surfaces of extension 10A which are continuations of the surfaces 11A and 11B. Due to the curved shape of the flow guiding surfaces, larger fuel droplets tend to centrifuge out of the mixture onto the walls of extension 10A. Normally, this separated fuel would re-enter the high speed channel exit streams at the extremities of the flow surfaces of extension 10A. This formerly separated fuel will be finely atomized by the severe turbulence at the location P where the high speed streams converge. To further enhance the mixing of the fuel with the air, passageway 40 may be provided in extension 10A. Passageway 40 is adapted to carry a heated fluid, such as liquid engine coolant or engine exhaust, to impart heat to the extension 10A. By this means, the surfaces 11A and 11B and their extensions become heated. This heat is carried to the liquid fuel which has separated onto the surfaces of extension 10A, thereby enhancing vaporization of this separated fuel. By vaporization, it is meant that the liquid fuel is converted to a gasseous state. Vaporized fuel mixes thoroughly with the intake mixture, and contributes substantially to increased combustion efficiency. FIG. 11 also schematically represents fuel outlet 30 as a fuel rail which extends transversely across passageway 12, parallel to and upstream of extension 10A. This rail may be of the type where a plurality of small holes are provided along the rail to evenly distribute fuel into the intake passageway.

Figure 12:
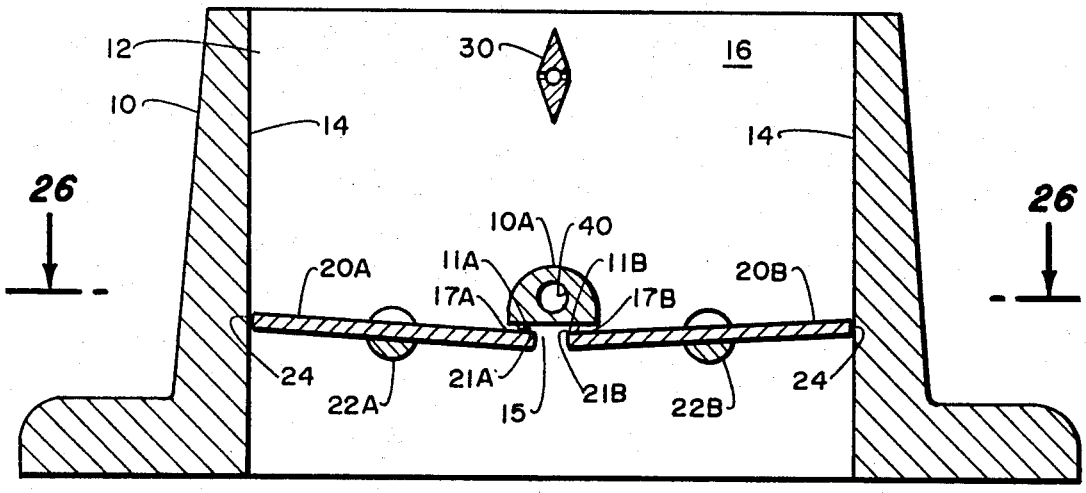
FIG. 12 is a cross sectional view of one embodiment of the present invention wherein cooperating surfaces are straight.

FIG. 12 illustrates an embodiment of the invention which is simple and economical to manufacture. The surfaces 11A and 11B are formed merely as part of the flat downstream surface of the transverse throttle body extension 10A. The throttle blades are shown in the partially open position. In embodiments of this kind, no recess is formed in the downstream surface of extension 10A. In the vicinity of collision point P of the channel exit streams, adjacent to the downstream surface of extension 10A, it has been shown that there exists a stagnant region of increased absolute pressure and low speed mixture flow. From this region liquid fuel tends to separate out of the mixture, eventually to re-enter the mixture in a manner which might result in less than optimal fuel atomization. In embodiments of this construction, it may be advantageous to provide heat from passageway 40 to assist in vaporizing the separated fuel.

FIG. 13 illustrates a top view of a section of FIG. 12 taken along the line 26—26. Illustrated more clearly in FIG. 13 are the gears 70 which effect synchronous rotation of the shafts 22A and 22B. Also shown is the passageway 40 which transports the heated fluid.

Figure 14:
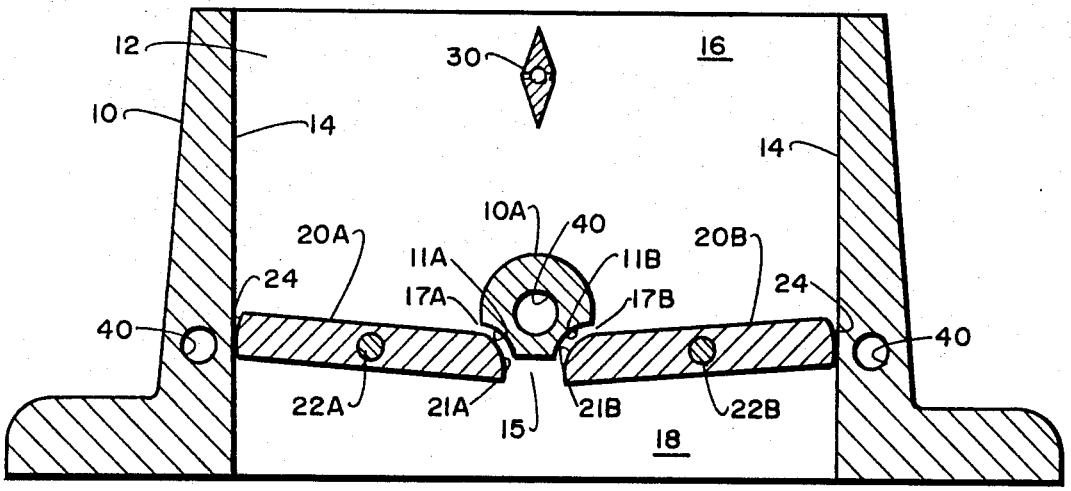
FIG. 14 is a cross sectional view of one embodiment of the present invention employing formed throttle blades and having curved partial throttle channels.

FIG. 14 illustrates an embodiment of the invention wherein the throttle blades may be formed by a process such as casting, or machined from solid stock, and precision machined to final tolerances. The throttle blades are thicker, and can be advantageously formed to enhance the function of the various surfaces which cooperate with the throttle body surfaces. In this embodiment, the edges 24 of the throttle blades which cooperate with the walls 14 of the throttle body 10 can be formed in a curved shape to more closely cooperate with the walls to preclude mixture flow over a greater range of rotation of the throttle blades. The channels illustrated here are more severely curved, to enhance separation of liquid fuel onto the extension 10A. The channel exit streams will coverge further downstream in passageway 12, at a lesser angle with reduced turbulence.

Figure 15:
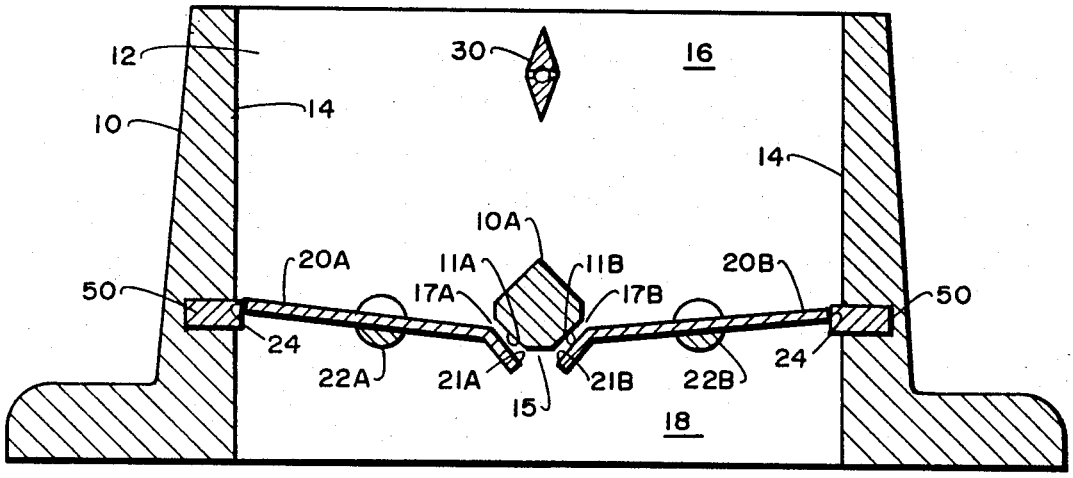
FIG. 15 is a cross sectional view of one embodiment of the present invention wherein the channel exit stream convergence is at right angles.

FIG. 15 illustrates an embodiment of the invention wherein stamped throttle blades are formed with an angled portion for locating surfaces 21A and 21B, to cooperate with angled surfaces 11A and 11B of extension 10A. This directs the channel exit streams to converge at a sharp angle for severe turbulence, yet the point of convergence is arranged to be further downstream in passageway 12, without the enhanced fuel separation common to embodiments previously described where convergence occurred further downstream. Additionally, the embodiment of FIG. 15 is provided with seals 50 which are adapted to slide in recesses in the throttle body to exert moderate pressure against edges 24 of the throttle blades for better sealing at small angles of throttle rotation.

Figure 16:
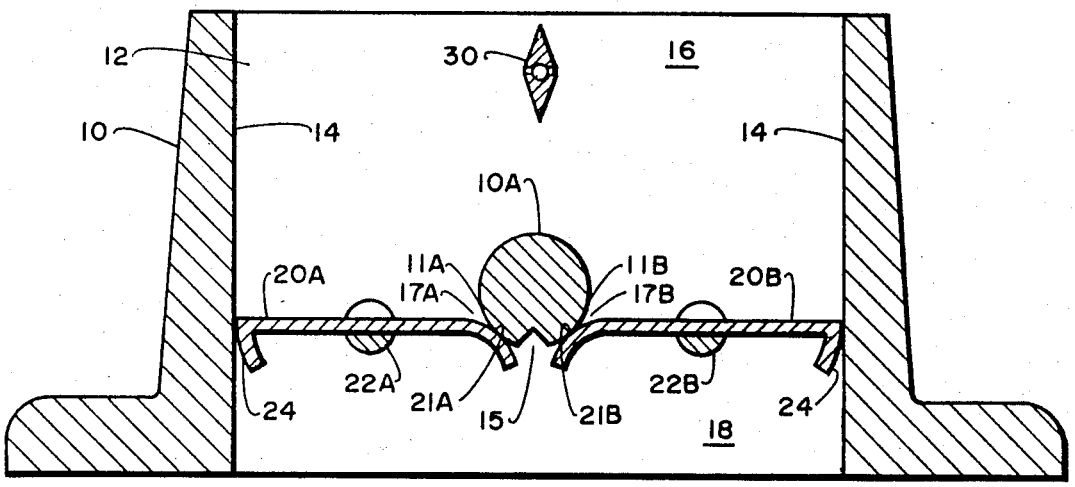
FIG. 16 is a cross sectional view of the intake passageway of one embodiment of the present invention wherein the channels have a first convergent, then divergent configuration.

FIG. 16 illustrates an embodiment of the invention wherein throttle blades are preferably stamped from metal sheet or strip stock, formed with special surfaces for enhanced flow control, and machined to final tolerances. In this embodiment, edges 24 are formed with a curved shape to cooperate more closely with walls 14 over a greater range of rotation of the throttle blades. The portion of the throttle blades having surfaces 21A and 21B are formed in a curved shape for cooperation with surfaces 11A and 11B, which are also curved. The resultant cooperation forms channels 17A and 17B which have a cross section that is first convergent, then divergent. This results in a flow through the channels where the mixture is accelreated to a high speed in the convergent part, then decelerated in the divergent part, where the divergent shape acts as a diffuser to recover the kinetic energy of the stream as static presure. Shapes such as this can ensure high velocity mixture flow through the channels even when the intake vacuum falls to lower levels. This configuration is commonly found in carburetors wherein supersonic flow is used to finely atomize the fuel.

Figure 17:
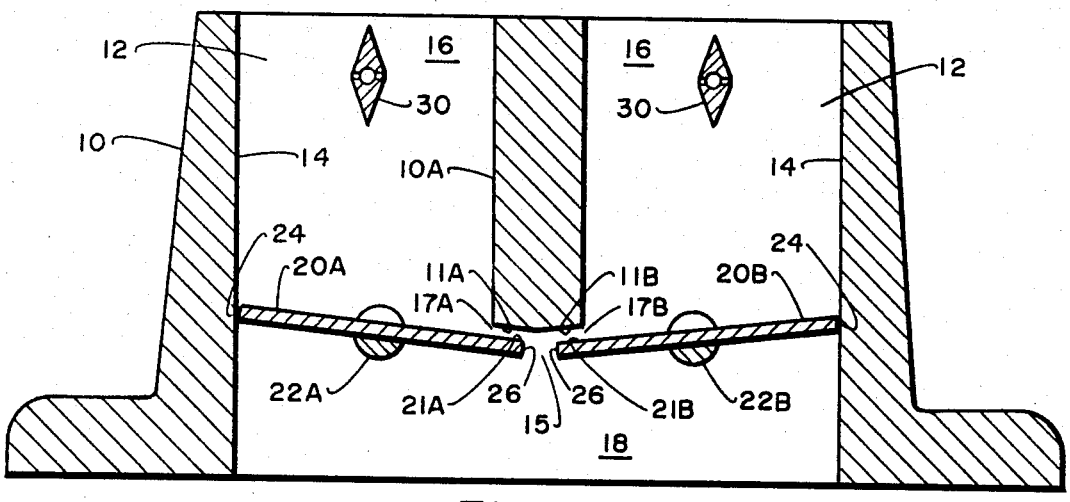
FIG. 17 is a cross sectional view of the intake passageway of one embodiment of the present invention wherein the transverse extension of the throttle body partitions the intake upstream of the throttle blades.

FIG. 17 illustrates an embodiment of the invention wherein the transverse extension 10A acts as a divider to separate the intake passageway 12 into sections. As shown, each section may be provided with a fuel outlet 30 to more evenly distribute fuel into the intake air.

Figure 18:
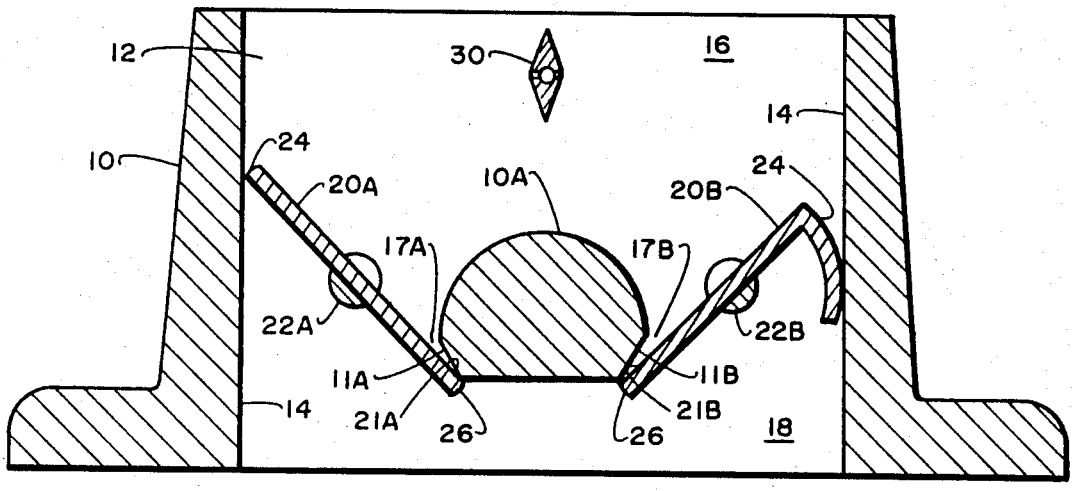
FIG. 18 is a cross sectional view of an embodiment of the present invention illustrating alternate configurations of the throttle blades and cooperations with the transverse extension.

FIG. 18 illustrates several alternate throttle blade structures or situations. Throttle blade 20A is situated at an angle to the axis of the intake passageway at closed throttle position. This allows the formation of an angled channel with reduced tendency of the liquid fuel to separate from the mixture at the entrance to channel 17A. However, the blade edge 24 will move more rapidly away from the wall 14, resulting in increased flow bypassing the channel 17A at lesser throttle openings. The advantages of throttle 20A can be enjoyed without the disadvantages by employing a configuration for the throttle such as that shown for the throttle blade 20B. Here, the edge 24 is formed as a curved portion of the blade for close cooperation with the wall 14 over a larger degree of rotation of the throttle.

Figure 19:
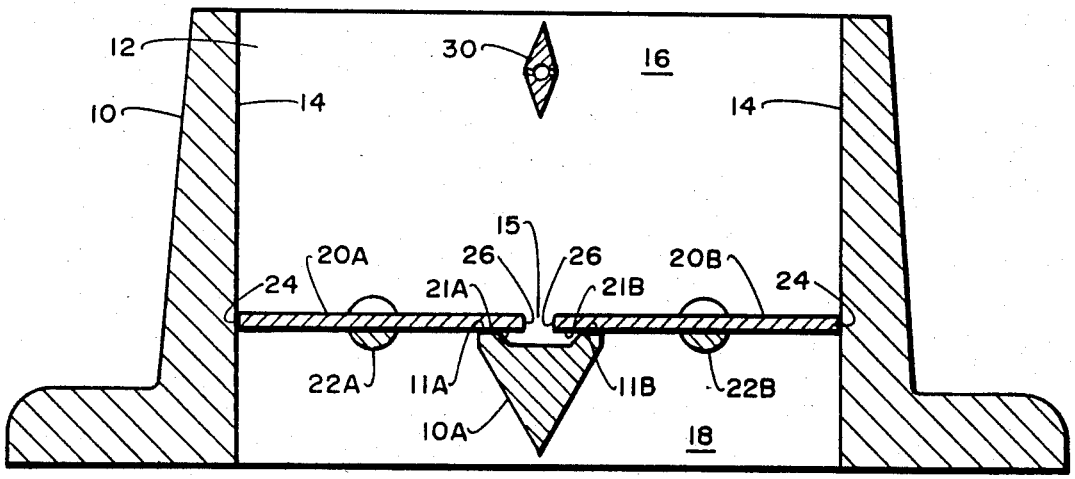
FIG. 19 is a cross sectional view of an embodiment of the present invention wherein the transverse extension is located downstream from the throttle blades.

FIG. 19 illustrates an embodiment of the invention having a variation wherein the transverse extension 10A is located downstream of the throttle blades. In this case, throttle shaft 22A rotates in a counterclockwise direction, while 22B rotates in a clockwise direction. This configuration can result in enhanced separation of liquid fuel onto the upstream surface of extension 10A. The channel exit streams flow toward the walls 14, and do not tend to converge.

Figure 20:
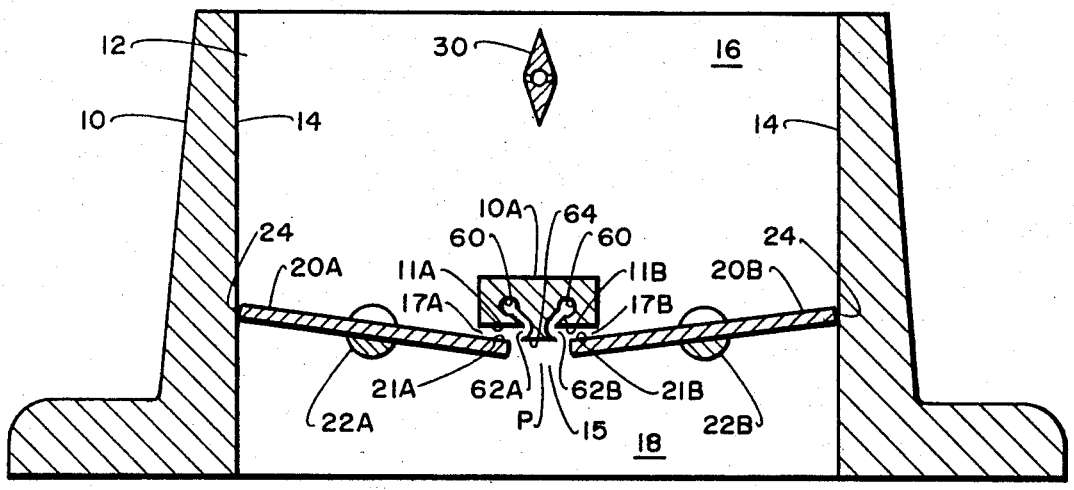
FIG. 20 is a cross sectional view of an embodiment of the present invention wherein the exit channel streams are directed toward passageways.

FIG. 20 illustrates an embodiment of the invention wherein the exit streams from the channels are directed into passageways at partial throttle openings; the passageways transport the fuel/air mixture to a heater, where heat is applied to the mixture to enhance fuel vaporization. The embodiment of FIG. 20 has a transverse extension 10A provided with passageways 60. Conduits 62A and 62B join the passageways 60 with the region 15 downstream of the throttle blades. The surfaces 11A and 11B lead into the conduits 62A and 62B respectively. A shaped portion 64 of the extension 10A directs the exit mixture streams from the channels 17A and 17B to the conduits 62A and 62B formed by the shaped portion 64 of extension 10A. The momentum of the high speeds mixture streams exiting the channels carries the mixture into the conduits 62A and 62B where the mixture is further transported to passageways 60. Passageways 60 transport the mixture to a heater or heat exchanger (not shown) where the mixture or the fuel in the mixture is heated to enhance liquid fuel vaporization. The mixture containing the vaporized fuel is re-introduced into the intake passageway 12 at a location (not shown) downstream from the throttles. At more open positions of the throttle, some of the mixture stream exiting the channels passes by the downstream surface of the shaped portion 64. The parts of the channel exit mixture streams which do not enter the conduits 62A and 62B converge and collide, in a manner as previously explained, at a location P downstream of the extension 10A. At much larger throttle openings the channel cross sections will be so large that only a much reduced part of the channel exit streams will be directed at the shaped entrances of the conduits 62A and 62B. Thus, the majority of the mixture exiting the channels will avoid the heater vaporization process and be mixed by the collision process which occurs at point P, downstream of the extension 10A. At low levels of intake vacuum, the streams exiting the channels may have insufficient momentum for a large amount of the fuel/air mixture to pass through the various conduit systems leading to the heater.

Figure 21:
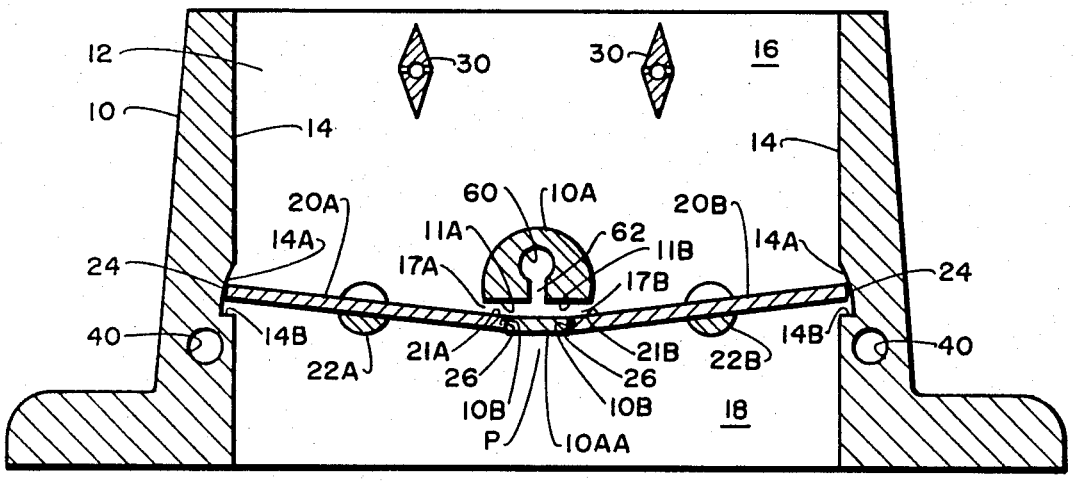
FIG. 21 is a cross sectional view of an embodiment of the present invention wherein the exit channel streams are directed toward passageways.

FIG. 21 illustrates an embodiment of the invention similar to the embodiment of FIG. 20, wherein the exit streams of fuel/air mixture from the channels enter a passageway in the transverse extension, whereby the mixture is transported to a heater for vaporization. In FIG. 21, shown with the throttle blades in the partially open position, the transverse extension of the throttle body 10A has conduits 62A and 62B leading to passageway 60. The part of extension 10A which is labelled 10AA is configured such that its edges 10B cooperate closely with the edges 26 of the throttle blades when the throttles are in the partially open position to essentially prevent the mixture exiting the channels from directly flowing to the passageway 12 immediately downstream from extension 10A. Rather, the mixture is forced by the close cooperation of surfaces 10B and edges 26 to flow into conduits 62A and 62B. The mixture subsequently flows through passageway 60 to be transported to a heater or heat exchanger (not shown), where the fuel is heated and vaporized. The mixture then re-enters the intake passgeway 12 at a location downstream of the throttles (not shown). Another advantageous feature of the embodiment of FIG. 21 are the curved areas 14A of the walls 14. The contour illustrated here allows the edges 24 of the throttle blades to maintain close cooperation with the walls 14A over an extended range of rotation of the throttles to preclude substantial airflow. Additionally, the ledges 14B serve as a rest for the throttle blades to aid in sealing this region when the throttles are in the fully closed position. At partial throttle openings, any mixture leaking past the cooperation of surfaces 14A and edges 24 is likely to impinge on the ledges at 14B, possibly resulting in some liquid fuel separation. Passageways 40 provide heat to enhance vaporization of any fuel separating onto the surfaces 14B.

When the throttles rotate more open such that the throttle edges 26 move past the extremities of surfaces 10B, the channel exit streams flow along the downstream surface of 10AA and collide at location P, and subsequently this embodiment functions in a manner identical to that described in reference to the operation of the embodiment of FIG. 20.

Figure 22:
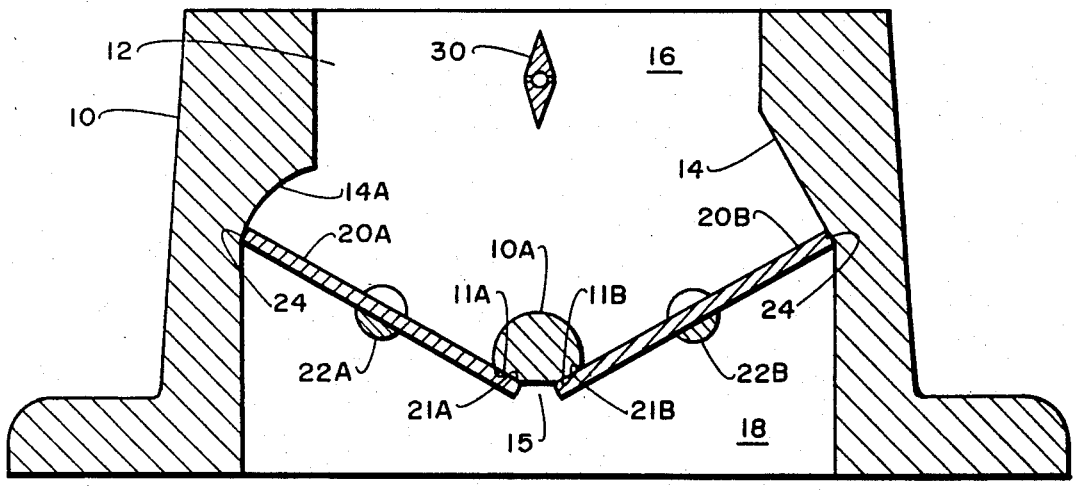
FIG. 22 is a cross sectional view of an embodiment of the present invention wherein two throttle blades are disposed in an angled relationship in the intake passageway.

FIG. 22 illustrates an embodiment of the present invention wherein the walls 14 of the intake passageway 12 are not straight, and throttle blades 20A and 20B are angled with respect to one another at the fully closed position. The edge 24 of blade 20A is shown cooperating with a portion 14A of the wall 14 that is curved, the curved part having a radius slightly greater than the distance to the axis of rotation of blade 20A. This configuration precludes flow of mixture past the cooperation of surfaces 14A and 24 over a greater range of throttle rotational positions. The edge 24 of blade 20B is shown cooperating with a portion of the wall 14 that is angled with respect to the major axis of the passageway 12. Note that the edge 24 of blade 20B moves essentially parallel to the cooperating region of wall 14 for the initial several degrees of opening throttle rotation.

Figure 23:
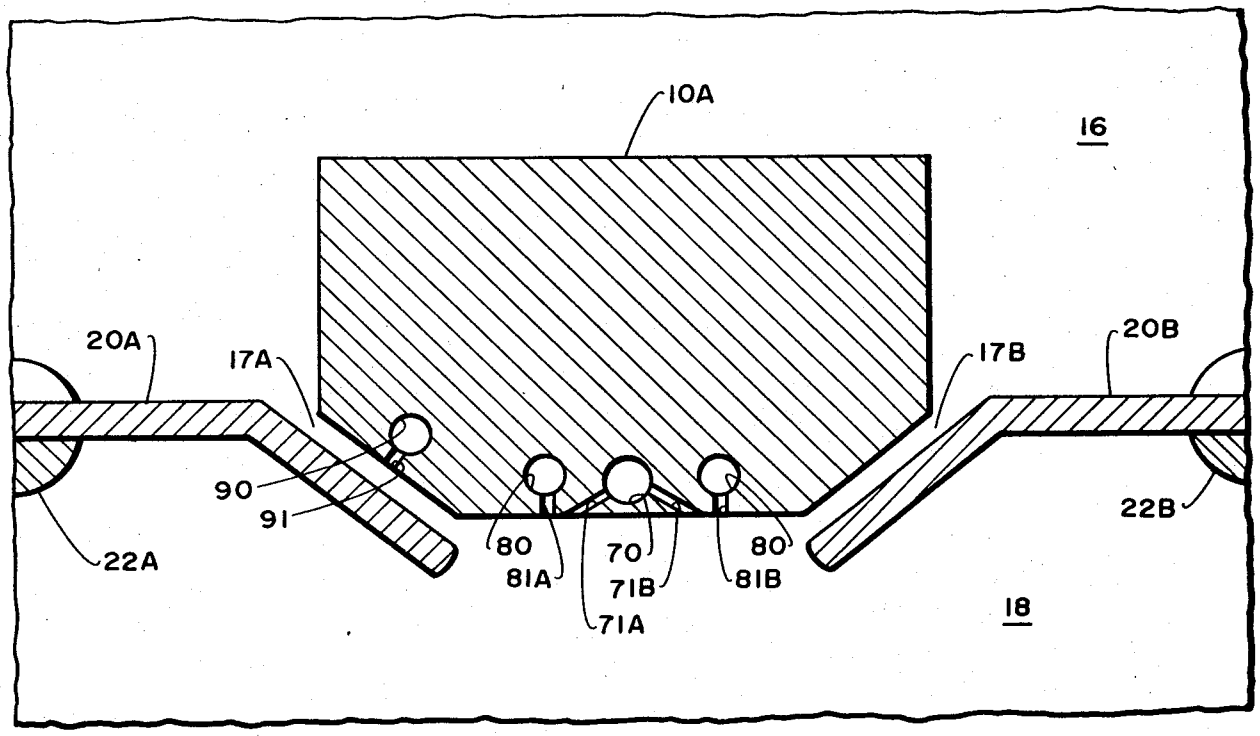
FIG. 23 illustrates an embodiment of the invention wherein fuel is introduced in or downstream from the channels.

FIG. 23 illustates several alternate and advantageous ways of introducing fuel into the inlet air in the present invention. FIG. 23 shows an embodiment of the invention having a transverse extension 10A, with which the throttles cooperate to form the channels 17A and 17B. Disposed in the extension 10A is the passageway 90 which transports fuel or fuel/air emulsion. The passageway 90 opens into the high speed region of the channel 17A through the port 91. The port 91 delivers fuel from passageway 90 into the inlet air flowing through the channel. The high speed of the air in the channel serves to finely atomize the fuel so introduced.

FIG. 23 also illustrates a particularly advantageous means of introducing fuel into the inlet air downstream from the channels. Fuel passageways 80 carry fuel or fuel/air emulsion for delivery to the inlet air. Ports 81A and 81B deliver fuel from passageways 80 into the air inlet downstream from the throttles. Passageway 70 transports air that is from a source of higher pressure than the pressure of the inlet at 18. Ports 71A and 71B direct air from passageway 70 into the air inlet. Air flows at high speeds out of the ports 71, and this high speed airflow is directed to impinge upon the channel exit streams. Fuel emanating from the ports 81 becomes entrained in the air exiting from the ports 71 and is driven at high speed into the channel exit streams. This provides a multi-stage process which results in very fine fuel atomization. The first stage occurs when the fuel from 81 meets and enters the relatively high speed airstream from the ports 71. This pre-prepares the liquid fuel by affording a relatively thorough pre-atomization. The second stage occurs as the fuel entrained in the air from ports 71 is driven into the channel exit streams. This provides excellent atomization. A third stage occurs when the exit streams collide. The overall result of this process is excellent atomization and suspension of the fuel in the inlet air.

With regard to FIG. 23, the ports 71 can be positioned for optimum atomization of fuel. For instance, it will be noted from FIG. 23 that the ports 71 direct emergent air nearly perpendicularly into the channel exit streams. The ports 71 could be situated so as to direct their exit air on a flow path that is nearly opposite the flow direction of the channel exit streams. This would result in a relative speed between the two streams that would be nearly twice the speed of either stream alone. Thus, the point of merging of the two streams would subject entrained fuel droplets to a very severe velocity change, resulting in improved atomization.

In the various specific embodiments of the invention described in detail herein, it will be noted that the edges 24 of the throttle blades are in close proximity with the walls 14 of of the intake passageway when the throttle blades are in the closed or idle position. Then, for the first several degrees of opening rotational movement of the throttles, the edges 24 are moving in a direction essentially parallel or nearly parallel to the walls 14 such that the rate of opening of the space between edges 24 and walls 14 is initially small. It is not necessary to configure the present invention only with straight walls parallel to the major axis of passageways 12, as illustrated in the majority of the Figures. Rather, any desired contour for the surfaces of the walls 14 can be advantageously employed, where the conditions for blade edge to wall cooperation are preferably met as described herein. Nevertheless, the contour of the walls should be such that effective closure of the passageway 12 can be achieved at closed or idle throttle positions. For example, the walls 14 could be straight but diverging in the region of the throttles, and the throttle blades angled with respect to one another such that the above conditions of cooperation are met. Curved walls could also be employed under similar conditions. Examples of some of these conditions are illustrated in the previously described FIG. 22.

In order to more clearly understand the structure and function of the invention, some terms are now defined. A channel is defined to be a region of cooperation between a throttle blade and the throttle body forming a flow path for inlet air to flow from a region of higher pressure upstream of the throttle to a region of lower pressure downstream from the throttle.

A channel exit stream is defined as the flow of inlet air that has exited a channel by flowing past the channel exit. A channel exit stream has a flow axis that is defined by the direction and speed of the center of mass of the exit stream. A channel exit is defined as a point at the downstream portion of the channel where the channel flow separates from either the throttle surface or the throttle body surface which form the channel.

In order for the channel exit streams to collide with sufficient severity to provide the advantageous atomization and fuel suspension functions of the present invention, it has been found that constraints exist with respect to the included angle between colliding exit streams. The included angles which result in favorable operation of the invention lie in the range of 45 degrees to 180 degress. For angles of less than 45 degrees, the severity of the collision of the exit streams is insufficient for improved atomization, and the flow stream which results after the collision retains sufficient coherence and speed to cause entrained fuel to separate out of the mixture wherever the stream meets a surface of the engine inlet. Best operation results from included angles of 90 degrees or more.

Although preferred embodiments of the invention described herein utilize an intake passageway of rectilinear cross section, it is fully appreciated and anticipated that intake passageways of many other configurations besides rectilinear, including round, may be employed to advantage within the scope of the present invention.

It is further appreciated and anticipated that there are many other ways of practicing the present invention besides the specific ways described in detail herein. For instance, a single carburetor throttle body assembly could be provided with a plurality of intake passageways, divided or undivided, wherein each intake passageway is equipped with a throttle blade configuration as described herein. Also, there could be provided in the intake passageway a number of throttle blades other than two, wherein there is throttle blade cooperation with the throttle body for forming channels. Also, gears have been indicated as the means for effecting coordinated rotation of the plurality of throttle blades in the intake passageway. It should be understood that there are many other linkages that could be advantageously used to operate a plurality of throttle blades in the present invention. Therefore, the foregoing Figures and description are intended to be illustrative only, and not limiting; the scope of the invention being as defined in the claims appended hereto.

What is claimed:

1. An apparatus for fuel and air mixing and flow modulation comprising:

throttle body means having an air inlet passageway means therein for flowing air to an internal combustion engine;

said air inlet means having an upstream end and a downstream end;

said throttle body means having extension means extending across said air inlet means;

a plurality of butterfly-type throttle blades rotatably disposed in said air inlet passageway for regulating air flowing through said inlet passageway;

a plurality of channel means;

each of said channel means formed by a region of cooperation of one of said throttle blades with said extension of said throttle body in response to a pressure difference between said upstream and downstream ends of said air inlet means;

each of said channel means acting to form a channel flow stream for flowing said air from upstream of said throttles to downstream from said throttles in response to a pressure difference between said upstream and downstream ends of said air inlet means;

each of said channel means flowing said channel flow stream so as to form a channel exit at a region of separation;

each of said channel means acting to form a channel exit stream by flowing said channel flow stream past said channel exit;

a plurality of channel exit streams;

each of said channel exit streams having a flow axis;

two of said channels being adapted to direct two channel exit streams on converging paths;

said two channel exit streams on converging paths converging such that the included angle between the flow axis of one converging exit stream with respect to the flow axis of the other converging exit stream is in the range of 45 to 180 degrees, and said two channel exit streams on converging paths colliding in said air inlet downstream from said throttle.

2. The apparatus according to claim 1 wherein said throttle body is heated to assist in vaporizing fuel contacting said throttle body.

* * * * *